US005708999A

United States Patent [19]

Priolo et al.

[11] Patent Number: 5,708,999

[45] Date of Patent: Jan. 20, 1998

[54] ADJUSTABLE THERAPEUTIC PILLOW

[76] Inventors: Gino John Priolo, 7 Worthview Court, Etobicoke, Ontario, Canada, M9R 4C1; Antonio Tari, 11 Gracedale Boulevard, North York, Ontario, Canada, M9L 2B7

[21] Appl. No.: 780,443

[22] Filed: Jan. 8, 1997

[51] Int. Cl.[6] ..... A47G 9/00; A47C 27/08

[52] U.S. Cl. ..... 5/644; 5/708

[58] Field of Search ..... 5/644, 654, 708, 5/710, 655.3, 715, 636

[56] References Cited

U.S. PATENT DOCUMENTS

| | | | |
|---|---|---|---|
| 3,251,075 | 5/1966 | Saltness et al. | 5/644 |
| 3,297,023 | 1/1967 | Foley | 5/654 |
| 3,795,021 | 3/1974 | Moniot | 5/644 |
| 5,173,979 | 12/1992 | Nennhaus | 5/644 |

FOREIGN PATENT DOCUMENTS

| | | | |
|---|---|---|---|
| 643128B | 5/1984 | Switzerland | 5/644 |

*Primary Examiner*—Alexander Grosz
*Attorney, Agent, or Firm*—Robert E. Vernon

[57] ABSTRACT

A support pillow combination comprises a support pillow having at least one bolster portion along one edge of the support pillow, and an inflatable under-pillow. The under-pillow comprises at least one row of a plurality of parallel inflatable air chambers. Each air chamber within a row is in fluid communication with each adjacent air chamber in the same row. Each of the rows are in fluid communication with a header and the header is connectable to an air source by a nozzle. Preferably the under-pillow has two rows of chambers, either in tube form or bubble form.

19 Claims, 7 Drawing Sheets

ADJUSTABLE THERAPEUTIC PILLOW

FIELD OF THE INVENTION

The present invention relates to a support pillow and in particular a support pillow which is adjustable in height.

BACKGROUND OF THE INVENTION

It is known that poor positioning of a person's head or neck during sleep can lead to headaches, stiff necks, shoulders and back pain. Pillows which are designed to support the head and neck during sleep are known. In general, the aim of such pillows is to support the head and neck in a position that they would occupy if the person were standing.

Contoured foam pillows are most recommended by doctors and health specialists. Such contoured foam pillows have a bolster portion which is intended to support the user's neck and a head support portion which is not as high as the bolster portion. Commercially such contoured foam pillows have two bolster portions, each at opposing edges of the pillow, separated by a valley which is the head support portion. The two bolsters are of different heights. The lower of the two bolsters is intended to accommodate a person sleeping on their back and the higher bolster is intended to accommodate a person sleeping on their side. The main disadvantages of such contoured foam pillows is that they only have two bolster heights from which to select, that they are not adjustable for lying on one's side or back, and that they do not accommodate people of different shoulder widths for those people who sleep on their sides.

A device for adjusting the height and firmness of the bolster, through the use of an inflatable bladder, is disclosed in U.S. Pat. No. 4,528,705 which issued Jul. 16, 1985 to M. H. Greenawalt. A similar device is shown in Canadian patent application 2099545, published Jan. 3, 1995 to C. Martin. The inflatable bladders in these devices are inside a foam bolster. One problem with having an inflatable bladder inside the bolster is that only the neck portion is elevated. A further problem is that inflation of the bladder affects the contour of the foam, i.e. alters the radius of the bolster. Both of these problems are undesirable because they distort the alignment of the spine, especially the upper vertebrae. Martin's patent application also discloses an inflatable bladder which is inside the head and bolster portions of the foam. Applicant has found that this arrangement is unsatisfactory because when the bladder is fully inflated, the bladder tends to assume a bulbous or spherical shape, thus defeating the purpose of a support pillow. When the bladder is underinflated and when the person's head lays on the pillow, the head depresses the bladder under the head and the displaced air tends to inflate the bladder in the portions away from the head. Accordingly, the support aspect of the pillow is lost.

The present invention is intended to alleviate the aforementioned difficulties. An improved pillow which is relatively inexpensive yet is particularly effective has now been found.

SUMMARY OF THE INVENTION

The present invention provides a support pillow combination which comprises a support pillow having at least one bolster portion along one edge of the support pillow, and an inflatable under-pillow, said under-pillow comprising at least one row of a plurality of parallel inflatable air chambers, each air chamber within a row being in fluid communication with each adjacent air chamber in the same row, and each of said rows being in fluid communication with a header, said header being connectable to an air source by a nozzle.

In one embodiment, there are a plurality of rows in one plane.

In another embodiment, the header is in fluid communication with at least one row in a first plane and at least one row in a second plane, the first and second planes being parallel to one another, and the rows in the first plane being adjacent to the rows in the second plane.

In a further embodiment, the chambers are tubes and the header is in fluid communication with a row of tubes in a first plane and a row of tubes in a second plane.

In yet another embodiment, the rows of air chambers are encased in an air-impervious flexible casing.

In a further embodiment, the support pillow combination comprises the support pillow and the under-pillow enveloped in a pillow case.

In another embodiment, the support pillow has a fluffy layer thereon, between the support pillow and the pillow case.

In yet another embodiment, the fluffy layer is a fibrefill layer.

In a further embodiment, the air source is an air pump.

DETAILED DESCRIPTION OF PREFERRED EMBODIMENTS

Figure 1:
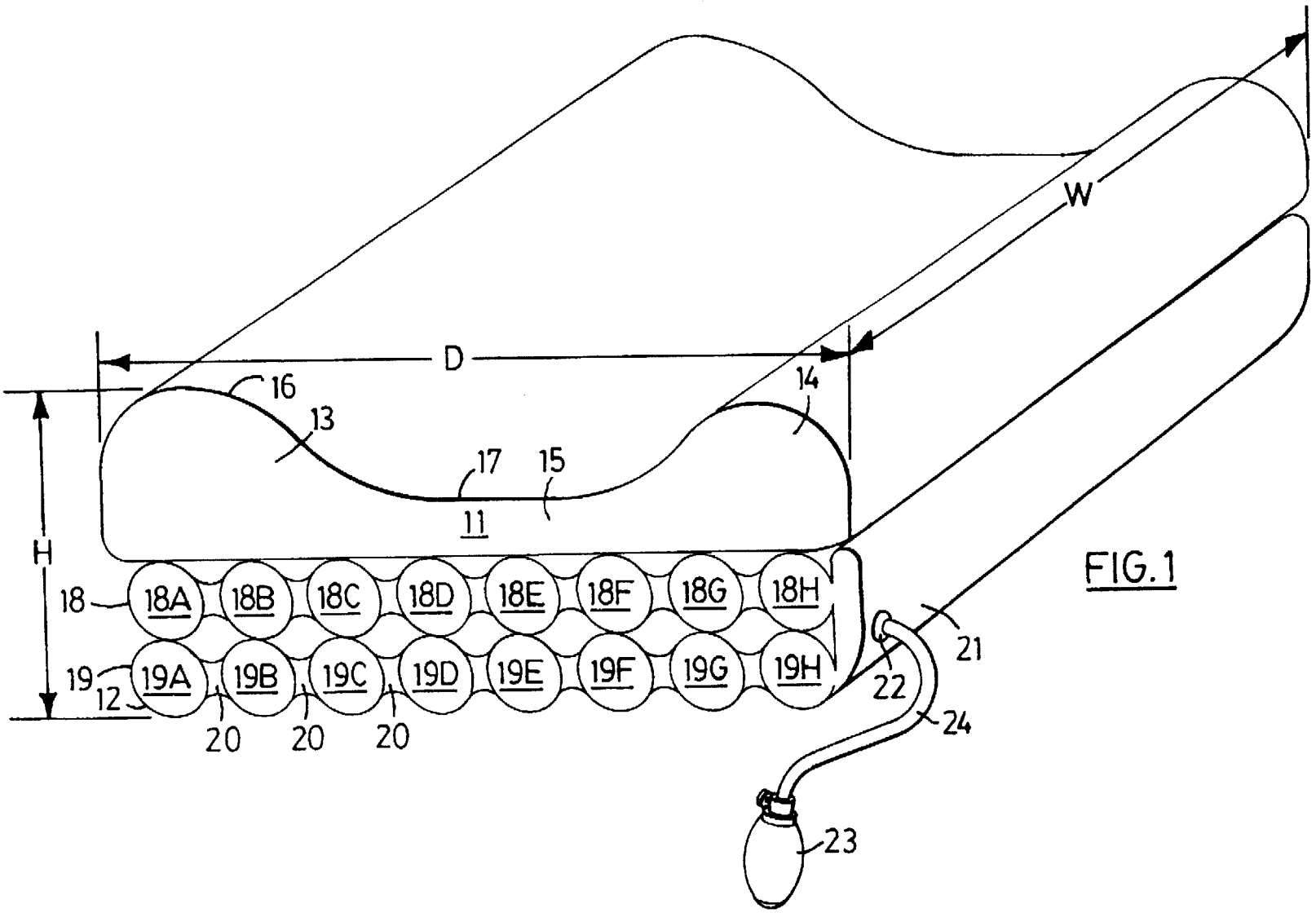
FIG. 1 is a perspective view of a pillow combination of the present invention.

FIG. 1 shows a contoured pillow 11 and an inflatable under-pillow 12. The contoured pillow 11 is typically made from a foamed resilient material, e.g. foamed polyurethane. Contoured pillow 11 comprises a first bolster portion 13 and a second bolster portion 14 separated by a head support portion 15. Contour surface 16 on bolster portion 13 is adapted to follow the shape of a person's neck and thus support the neck. Contour surface 17, which is contiguous with contour surface 16 is adapted to support the person's head. Inflatable under-pillow 12 has two rows of inflatable tubes, each row being in a different plane. The row 18 adjacent the contoured pillow 11 is in a first plane and has eight tubes 18A to 18H which are parallel to the longitudinal directions of the bolsters 13 and 14. Underneath row 18 is a second row 19 of tubes 19A to 19H, which are in a second plane. Each of the tubes in rows 18 and 19 are in fluid communication with adjacent tubes in the same row. Fluid communication is through passageways 20, three of which are identified between tubes 19A to 19D in FIG. 1 in row 19. Rows 18 and 19 are in fluid communication with header chamber 21. Header chamber 21 has an air nozzle 22 attached thereto. Header chamber 21 is sealed along line 70, which is shown also in FIG. 2. Seal 70 provides a means for preventing chamber 21 from ballooning into a tube of circular cross-section, i.e. it assists in keeping chamber 21 relatively flat. Air nozzle 22 may be connected to an air pump 23 via tube 24. FIG. 1 shows air pump 23 to be a hand-operated rubber or latex bulb. This can be replaced by an electrically-operated or battery-operated air pump. The contoured pillow has a width W and a depth D. The pillow combination has a height H which is variable, depending on the amount of inflation of under-pillow 12.

Figure 2:
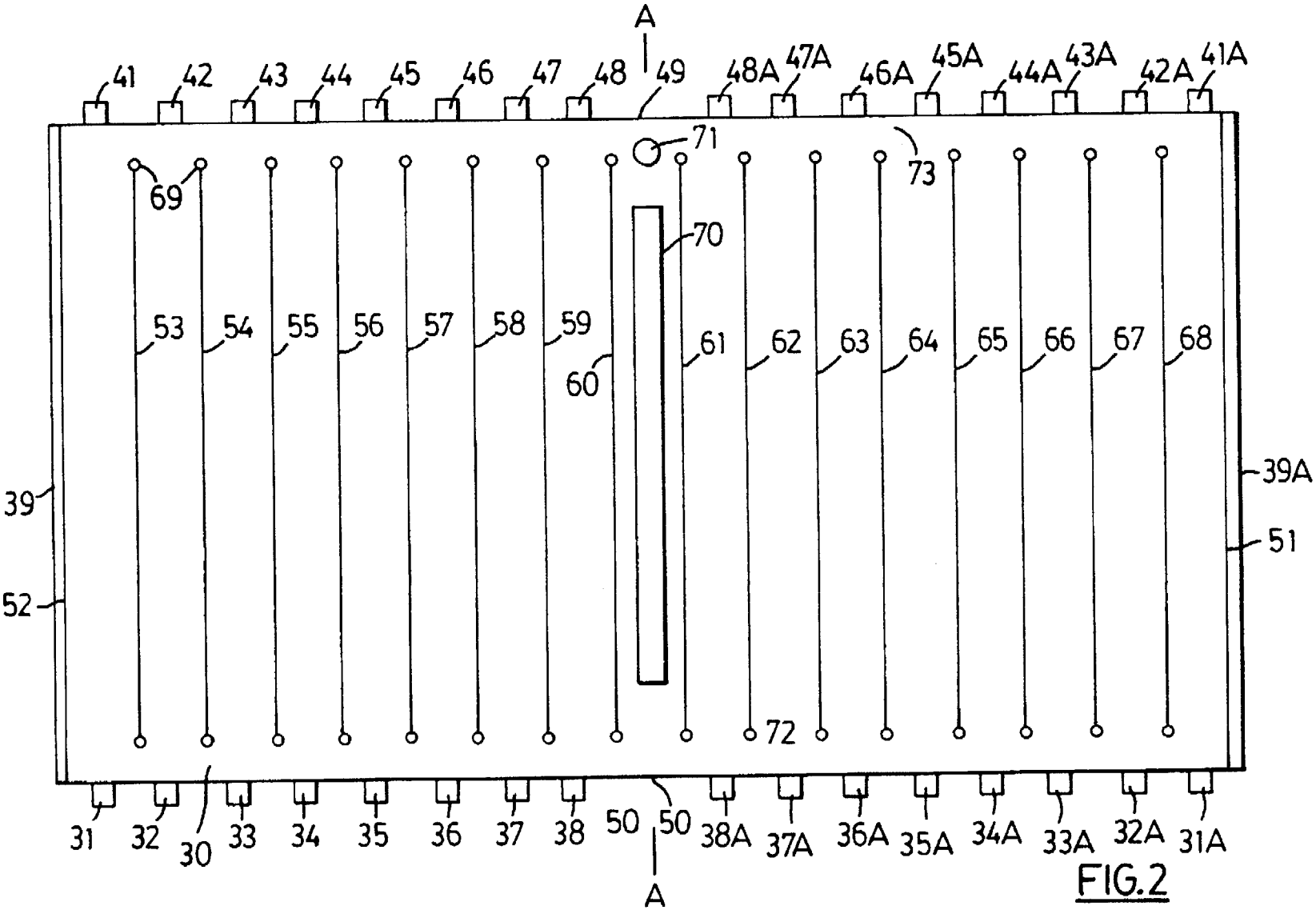
FIG. 2 is a plan view of an under-pillow having rows of tubes, prior to the rows being folded so that there are two rows of tubes, each row being in one plane.

The construction of a two-row under-pillow is more clearly seen in FIG. 2. Two substantially rectangular sheets 30 are laid one on top of the other and are sealed around their periphery along side edges 49 and 50 and end edges 51 and 52, making the rectangular sheets hermetically sealed. Typically the sheets 30 are made from a heat-sealable synthetic thermoplastic material such as cold rolled polyvinylchloride (PVC). The sheets are also sealed together along lines 53 to 68 which are parallel to end edges 50 and 51. The sheet material between adjacently sealed seals, e.g. 53 and 54, form the enclosing material for an inflatable chamber in the form of a tube. Seals 53 to 68 do not extend to side edges 49 and 50 so that there are passageways 72 and 73 which provide fluid communication between the adjacent tubes. In one of sheets 30, there is located an air nozzle 71 through which air can be transmitted in or out of the tubular structure. The central tube has a rectangular seal 70 to form a relatively flat chamber for the header chamber (see 21 in FIG. 1). Each of the ends of seals 53 to 68 have circular seals 69 which provide stress relief points so that the sheets are not so easily stressed and torn at those points when the tubes are inflated.

On the outer edges of end seals 51 and 52 are end tabs 39 and 39A. On the outer edges of side seals 49 and 50 are tabs 31 to 38, 31A to 38A, 41 to 48 and 41A to 48A. The tabs are located between the parallel seals 53 to 68. For example tabs 46 and 36 are located between imaginary extensions of seals 57 and 58. After sheets 30 have been sealed in the pattern shown in FIG. 2, sheets 30 are folded about line A—A so that air nozzle 71 remains visible. End tabs 39 and 39A are then sealed together at their distal edge. Side tabs 41 and 41A, 42 and 42A, 43 and 43A, 44 and 44A, 45 and 45A, 46 and 46A, 47 and 47A, and 48 and 48A respectively are sealed at the edges furthest away from side edge 49. Similarly, side tabs 31 to 38 and 31A to 38A are sealed together. The sheets are so folded that when the tubes are inflated through air nozzle 71, a double row of tubes are formed, as shown in FIG. 1. Each row of tubes is in a different plane. The planes are adjacent to one another.

Figure 6:
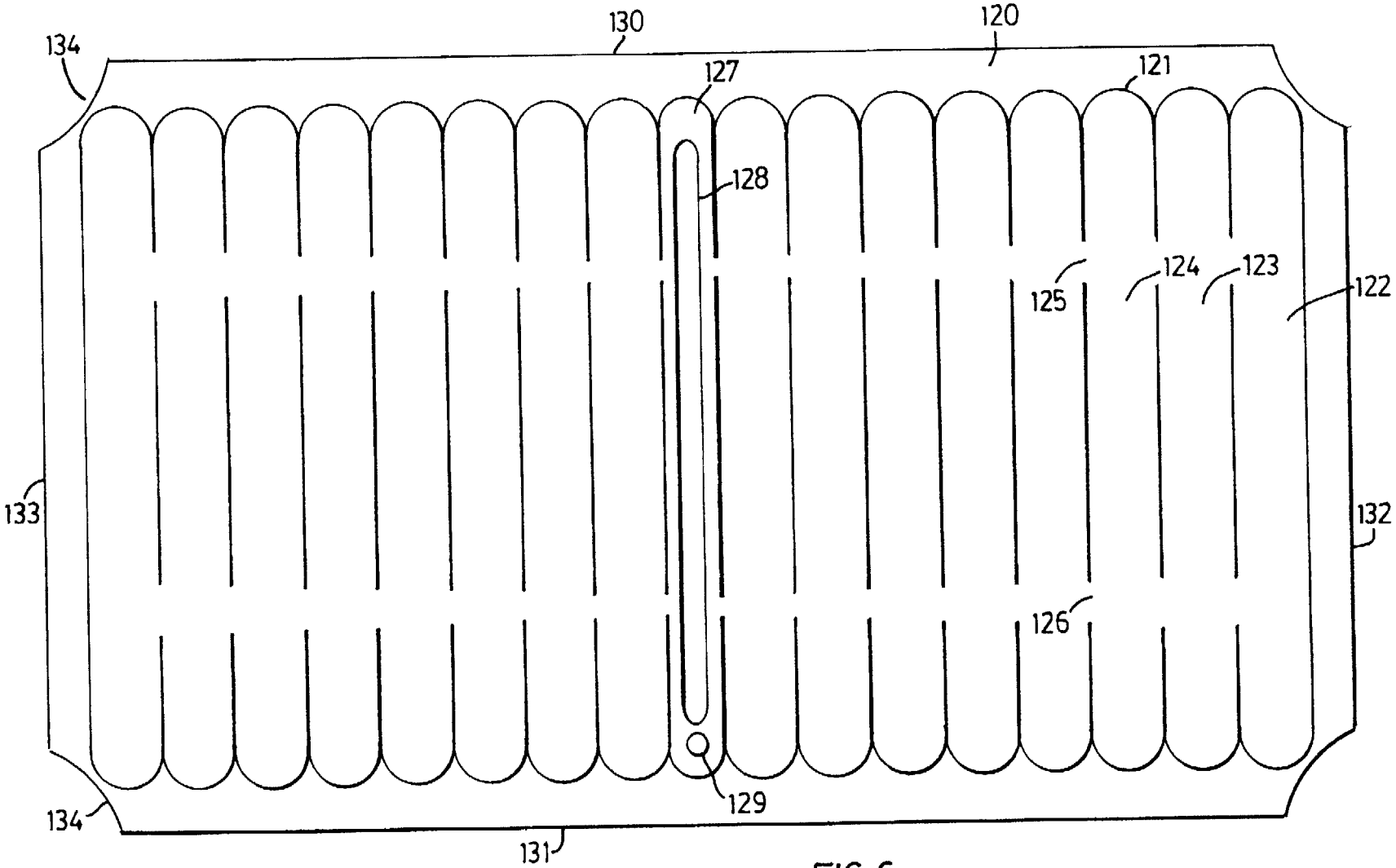
FIG. 6 is a plan view of another under-pillow having rows of tubes, prior to the rows being folded so that there are two rows of tubes, each row being in one plane.

Passageways 72 and 73 are made wide enough to allow a slow flow of air between adjacent tubes. It will be understood that a single passageway may be used. It will also be understood that the tubes could be split transversely by one or more passageways between passageways 72 and 73. FIG. 6 shows a configuration like this, but without passageways similar to 72 and 73 of FIG. 2.

Figure 3:
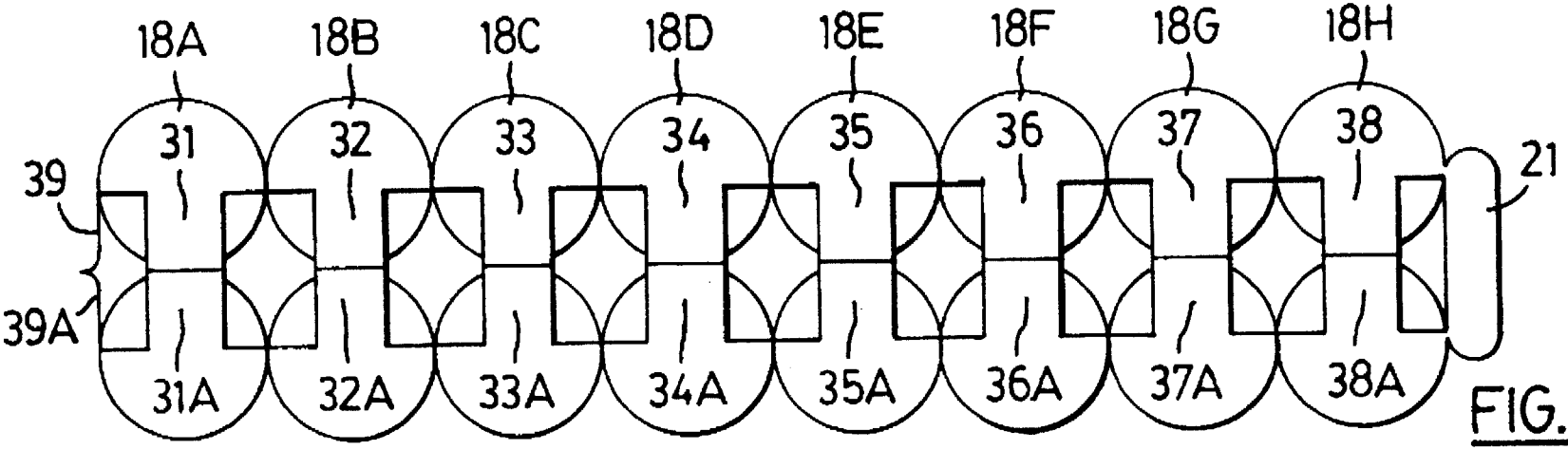
FIG. 3 is an end view of an inflated two-plane under-pillow with securing tabs.

In FIG. 3, the joined side tabs 31 to 38 and 31A to 38A, and the joined end tabs 39 and 39A may be seen.

Figure 4:
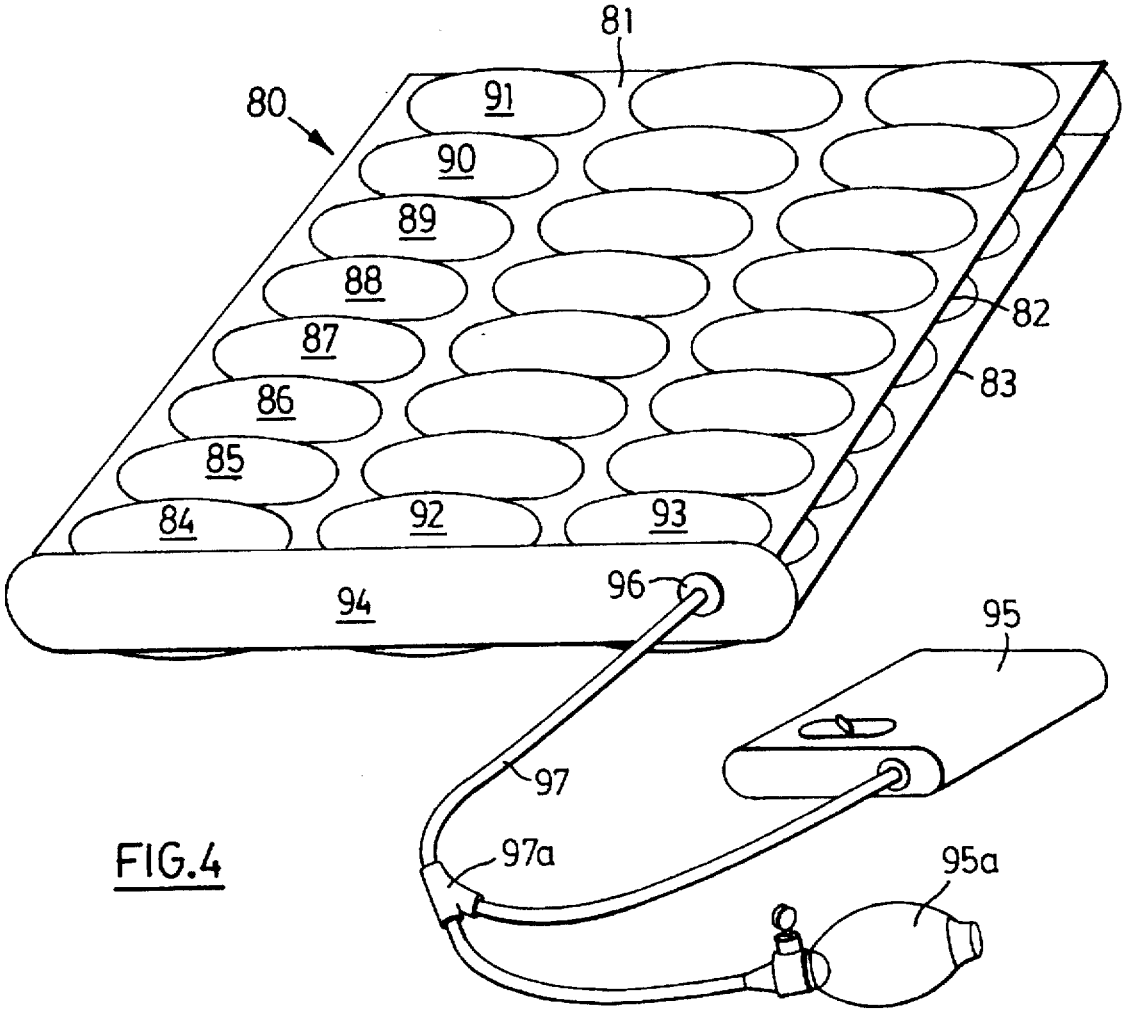
FIG. 4 is a perspective view of an under-pillow having two planes of bubbles, and three rows of bubbles in each plane.

FIG. 4 shows another under-pillow suitable for use in the present invention. The under-pillow 80 has been vacuum formed from two sheets 81 of a thermoplastic synthetic polymer, eg. PVC, polystyrene. Each layer 82 and 83 comprises a plurality of rows and columns of inflatable chambers in the form of bubbles. A single row of bubbles is shown at 84 to 91. A single column of bubbles is shown by bubbles 84, 92 and 93. Adjacent inflatable bubbles, eg. 85 and 86 are in fluid communication with one another and each row of bubbles is in fluid communication with a header 94. Header 94 is connectable to battery operated air pump 95 through a nozzle 96 in the header and air tube 97. As will be seen in FIG. 4, air tube 97 may be bifurcated at Y-junction 97*a* so that air may be provided by battery operated air pump 95 or hand pump 95*a*. The air pump has a manually-operated relief valve for releasing air from the under-pillow.

Figure 5:
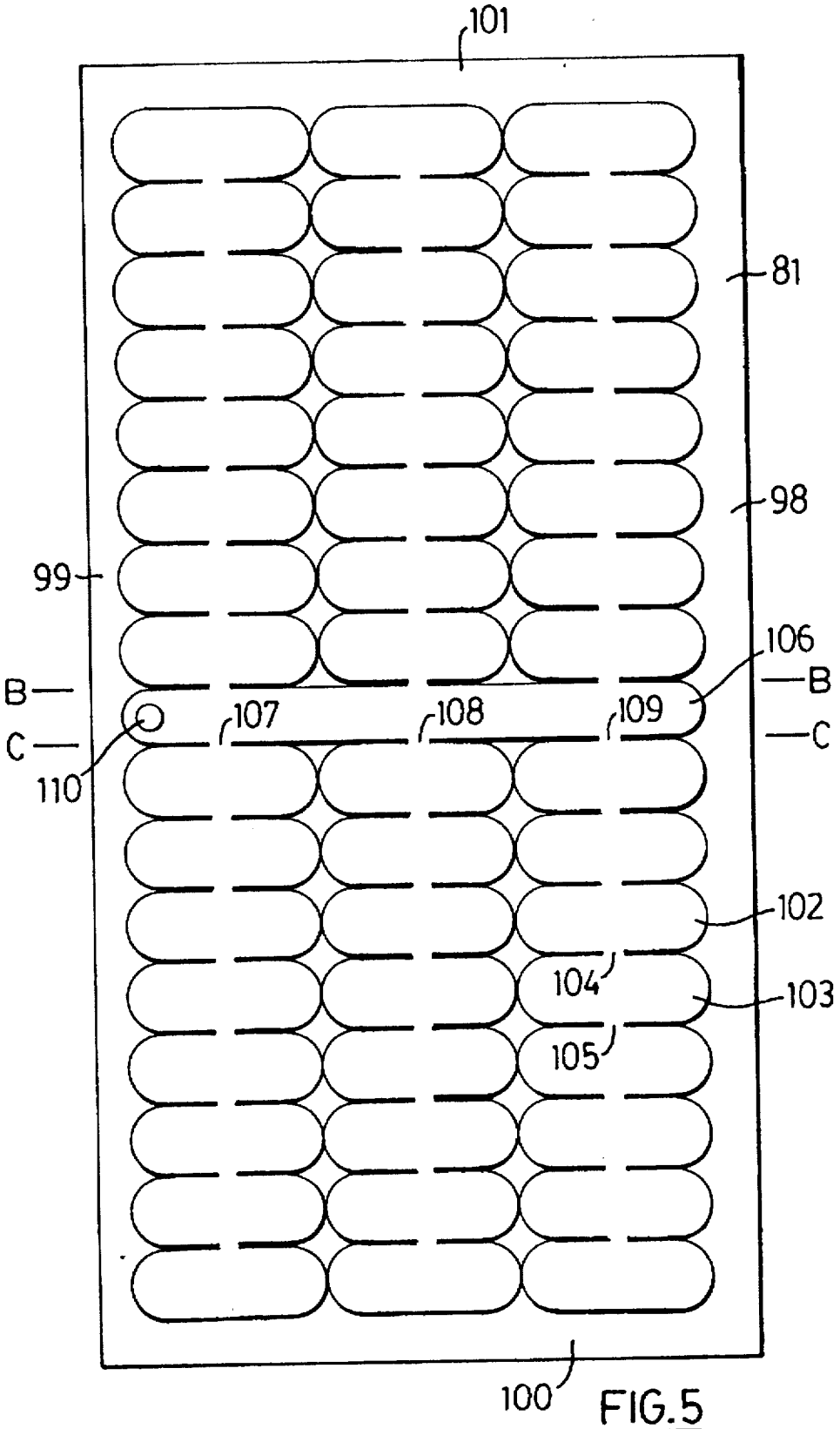
FIG. 5 is a plan view of the under-pillow of FIG. 4 prior to the rows of bubbles being folded into two planes.

The under-pillow of FIG. 4 is made from two PVC sheets as shown in FIG. 5. In FIG. 5 each sheet 81 is vacuum formed in a heated platen to give the bubble shapes shown in FIG. 4. The sheets are then placed one on top of the other and are heat sealed around the edges of the bubbles, eg. 102, 103 to keep the integrity of the bubble shape when inflated. There are gaps, eg. 104, 105 in the heat seals, between adjacent bubbles in a row to permit air to travel between adjacent bubbles. Each row is in fluid communication with the header 106 through gaps in the heat seals, shown for example at gaps 107–109. One of the sheets 81 has a nozzle 110 within the header 106 so that air can be introduced or removed from the header, and thus the bubbles. The heat sealed sheets are then folded about lines B—B and C—C to form the two-layer under-pillow as shown in FIG. 4. After folding the periphery at side edges 98 and 99, and end edges 100 and 101, is sealed in order to keep the bubble structure aligned as in FIG. 4. Sealing of the sides is not shown in FIG. 4, for clarity of understanding the drawing.

FIG. 6 shows a different layout for the rows of tubes but in many ways is similar to the embodiment of FIG. 5. In FIG. 6, each sheet 120 is vacuum formed in a platen to give tubular shapes, e.g. 122, 123, 124. Each tubular shape is joined to an adjacent tubular shape by two air gaps, e.g. 125 and 126. A central tube 127 has an air inlet nozzle 129 and a longitudinally-aligned continuous seal 128. The function of seal 128 is to form a flat header from tube 127. The seals for the tubes do not go entirely up to the edges 130–133 of sheet 120, so that the edges may be used in a manner similar to the tabs shown in FIG. 2. The corners 134 of sheet 120 are cut off so that the formed double-row of tubes does not have an "ear" at each corner.

It will be understood that the tubes of the embodiment of FIGS. 1 and 2 may be straight, sinusoidal or other shape along their length. They may also have air passageways between adjacent tubes in places other than at their ends, eg. at intervals similar to that shown for the bubble configuration of FIGS. 4 and 5. It will also be understood that the air nozzle for introduction of air into the chamber system may be inserted into to any of the chambers, i.e. it is not necessary that the nozzle be inserted in the header. It will be further understood that any of the chambers may act as the header for introduction of air. In the embodiments shown in the Figures, the header is shown in a central location for faster flow of air from one end of the rows to the other.

It is preferable that the contoured pillow and inflatable under-pillow be enveloped in a fitted pillow case. The pillow case may serve to keep the contoured pillow and under-pillow together during sleep of the user and provides a washable protective cover for the contoured pillow. Typically the pillow case is made of cotton or cotton-polyester fabric. For aesthetic reasons and comfort, a quilted pillow case is preferred.

The contoured pillow and under-pillow may be held together with loop and hook fasteners, e.g. Velcro®, two-way tape, tie tapes, snap fasteners or other means. Prefastening of the contoured pillow and under-pillow is helpful when inserting the combination into the fitted pillow case.

Figure 7:
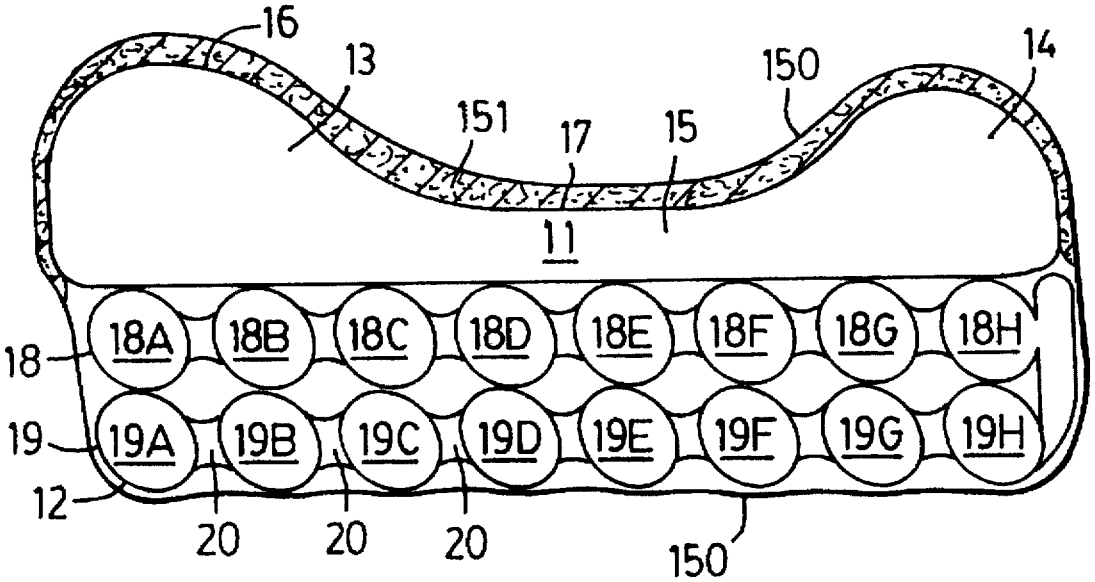
FIG. 7 is a cross-sectional view of a pillow combination similar to that shown in FIG. 1 but additionally having a fluffy layer and a pillow case.

For better comfort the contoured pillow combination comprises an under-pillow, a contoured pillow, a fluffy layer 151 over the contoured pillow, the whole being enveloped in a fitted pillow case 150, as shown in FIG. 7. The fluffy layer may be in batting form and is conveniently made with polyester or nylon fibres, although other fibres, either natural or synthetic, may be used. A preferred layer is a polyester fibrefill batting.

It will be understood that the contoured pillow may be made with materials other than foam, eg. down, fibrefill, or other suitable materials known in the art. Additionally the contoured pillow may have a single bolster along one edge of the contoured pillow, two bolsters on opposing edges as shown in FIG. 1 or even four bolsters around the four edges of the pillow. Each bolster would be at a different height or contour to the others. Typical pillow dimensions are about 60 cm wide (W), 45 cm deep (D) without being limiting. A typical contoured pillow has a height of 10–12 cm and the under-pillow typically may be inflated to a height of about 15 cm, so that the total height (H) of the pillow may be from about 10 to about 27 cm.

The underpillow may be made from any air-impervious flexible material that can be joined to form tubes or bubbles as described herein. For example, the material may be natural or synthetic rubber, rubberized fabric, cloth and plastic film laminates, thermoplastic polymeric films e.g. PVC, polyethylene, polystyrene. The seals may be made by any suitable method, e.g. glue, heat sealing.

When in use, a person may adjust the height of the pillow combination by pumping air through the header and into the chambers. Most usually the under-pillow is underinflated. The relatively narrow air passageways between chambers permit only a slow transmission of air from one chamber to another, thus avoiding the weight of the person's the head from pushing the air inside the chambers under the head to another portion of the pillow. Inflation of the under-pillow is easily adjusted either by pumping more air into the header or by allowing air to escape from the header to atmosphere.

In the present invention, it is important that bolsters of the contoured pillow do not change in shape and that the under-pillow is used merely to elevate the contoured pillow.

We claim:

1. A support pillow combination which comprises a support pillow having at least one bolster portion along one edge of the support pillow, and an inflatable under-pillow, said under-pillow comprising at least one row of a plurality of parallel inflatable air chambers, each air chamber within a row being in fluid communication with each adjacent air chamber in the same row, and each of said rows being in fluid communication with a header, said header being connectable to an air source by a nozzle.

2. A support pillow combination according to claim 1 wherein there are a plurality of rows in one plane.

3. A support pillow combination according to claim 1 wherein the header is in fluid communication with at least one row in a first plane and at least one row in a second plane, the first and second planes being parallel to one another, and the rows in the first plane being adjacent to the rows in the second plane.

4. A support pillow combination according to claim 3 wherein the chambers are tubes and the header is in fluid communication with a row of tubes in a first plane and a row of tubes in a second plane.

5. A support pillow combination according to claim 4 wherein the rows of air chambers are encased in an air-impervious flexible casing.

6. A support pillow combination of claim 4 wherein the support pillow and under-pillow are enveloped in a pillow case.

7. A support pillow combination of claim 6 wherein there is a fluffy layer between the support pillow and the pillow case.

8. A support pillow combination of claim 7 wherein the fluffy layer is a fibrefill batting.

9. A support pillow combination of claim 6 wherein the air source is an air pump.

10. A support pillow combination according to claim 3 wherein the rows of air chambers are encased in an air-impervious flexible casing.

11. A support pillow combination of claim 3 wherein the support pillow and under-pillow are enveloped in a pillow case.

12. A support pillow combination of claim 11 wherein there is a fluffy layer between the support pillow and the pillow case.

13. A support pillow combination of claim 12 wherein the fluffy layer is a fibrefill batting.

14. A support pillow combination of claim 11 wherein the air source is an air pump.

15. A support pillow combination according to claim 1 wherein the rows of air chambers are encased in an air-impervious flexible casing.

16. A support pillow combination of claim 1 wherein the support pillow and under-pillow are enveloped in a pillow case.

17. A support pillow combination of claim 16 wherein there is a fluffy layer between the support pillow and the pillow case.

18. A support pillow combination of claim 17 wherein the fluffy layer is a fibrefill batting.

19. A support pillow combination of claim 16 wherein the air source is an air pump.

* * * * *